US010333246B2

(12) United States Patent
Oishi et al.

(10) Patent No.: US 10,333,246 B2
(45) Date of Patent: Jun. 25, 2019

(54) WATERPROOF STRUCTURE OF CONNECTOR

(71) Applicants: YAZAKI CORPORATION, Tokyo (JP); HONDA MOTOR CO., LTD., Tokyo (JP)

(72) Inventors: Kozo Oishi, Tochigi (JP); Tomoyuki Miyakawa, Tochigi (JP); Kazuyuki Ochiai, Saitama (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/068,664

(22) PCT Filed: Dec. 28, 2016

(86) PCT No.: PCT/JP2016/089060
§ 371 (c)(1),
(2) Date: Jul. 6, 2018

(87) PCT Pub. No.: WO2017/119387
PCT Pub. Date: Jul. 13, 2017

(65) Prior Publication Data

US 2019/0020146 A1 Jan. 17, 2019

(30) Foreign Application Priority Data

Jan. 7, 2016 (JP) ..... 2016-001896

(51) Int. Cl.
*H01R 13/52* (2006.01)
*H01R 13/62* (2006.01)

(52) U.S. Cl.
CPC ..... *H01R 13/5219* (2013.01); *H01R 13/62* (2013.01)

(58) Field of Classification Search
CPC ..... H01R 13/5219
See application file for complete search history.

(56) References Cited

U.S. PATENT DOCUMENTS 3,562,696 A * 2/1971 Barnhart et al. ..... H01R 24/76 439/248
8,016,603 B1 9/2011 Tsai et al.
(Continued)

FOREIGN PATENT DOCUMENTS

CN 1767274 A 5/2006
CN 101714720 A 5/2010
(Continued)

OTHER PUBLICATIONS

English language Written Opinion of the International Search Report for PCT/JP2016/089060 dated Apr. 4, 2017.
(Continued)

*Primary Examiner* — Tho D Ta
(74) *Attorney, Agent, or Firm* — Kenealy Vaidya LLP

(57) ABSTRACT

In a waterproof structure of a connector (11), each of a pair of housings (17, 19) has an annular member (51, 81) projecting in a fitting direction. An outer circumferential surface (81*a*) of one annular member (81) is inclined so as to spread outward in the radial direction from the front end toward the back, and presses the inner circumferential surface of the other annular member (51) at the time of fitting. The curvature of the outer circumferential surface of the plurality of corner parts (109*a* to 109*d*) of the annular member (81*a*) is larger than the curvature of the outer circumferential surface of the other portion, and the inclination angle of the former outer circumferential surface with respect to the fitting direction is larger than the inclination angle with respect to the fitting direction of the latter outer circumferential surface.

5 Claims, 8 Drawing Sheets

(56) References Cited

U.S. PATENT DOCUMENTS

| | | | | |
|---|---|---|---|---|
| 9,755,352 | B2 * | 9/2017 | Hamada | H01R 24/20 |
| 2008/0009186 | A1 | 1/2008 | Hiramatsu | |
| 2016/0248193 | A1 * | 8/2016 | Hamada | H01R 13/5221 |
| 2017/0033493 | A1 | 2/2017 | Hamada et al. | |
| 2018/0191099 | A1 * | 7/2018 | Hamada | H01R 13/52 |

FOREIGN PATENT DOCUMENTS

| | | | |
|---|---|---|---|
| CN | 101882719 | A | 11/2010 |
| CN | 101950902 | A | 1/2011 |
| EP | 1 492 204 | A1 | 12/2004 |
| GB | 2 454 358 | A | 5/2009 |
| JP | 2002-198127 | A | 7/2002 |
| JP | 2008-16262 | A | 1/2008 |
| JP | 2013-229168 | A | 11/2013 |
| JP | 2016-157594 | A | 9/2016 |
| WO | 2011/076601 | A1 | 6/2011 |
| WO | 2015/166928 | A1 | 11/2015 |

OTHER PUBLICATIONS

International Search Report and Written Opinion of the International Search Report for PCT/JP2016/089060 dated Apr. 4, 2017.
The extended European search report for the related European patent application No. 16883886.0 dated Dec. 19, 2018.
Chinese Office Action for the related Chinese Patent Application No. 201680077687.6 dated Mar. 5, 2019.

* cited by examiner

WATERPROOF STRUCTURE OF CONNECTOR

TECHNICAL FIELD

The present invention relates to a waterproof structure of a connector.

BACKGROUND ART

In the related art, a waterproof connector for connecting electric wires has been mounted on an automobile or the like. For example, a waterproof connector has been known which includes a female connector in which a tubular inner housing formed with a cavity for accommodating a female terminal and a tubular outer housing surrounding the inner housing are integrally formed, and a female connector having a tubular male housing in which a cavity for accommodating a male terminal is formed, and the a waterproof connector is formed by fitting both connectors.

In this type of waterproof connector, an annular rubber packing is mounted on the outer circumferential surface of the inner housing of the female connector. When both connectors are fitted together, the male housing is inserted into a gap between the inner housing and the outer housing of the female connector. The packing is brought into close contact with an outer circumferential surface of the inner housing and an inner circumferential surface of the male housing, respectively, thereby preventing water from entering the gap between the cavities.

However, this type of waterproof structure requires a space for mounting the packing inside the female connector. Therefore, the outer diameter size of the waterproof connector increases. Also, the male housing is inserted into the female housing, while pressing the packing. Therefore, the load upon insertion of the male housing is increased. Thus, as a waterproof structure which does not use packing, for example, a structure is known in which a disc-shaped elastic plate is provided on the inner surface on the back side of the female housing, and when both connectors are fitted together, the housing leading end in the fitting direction of the male housing inserted into the female housing is brought into contact with the sealing plate to prevent water from entering (for example, see Patent Literature 1).

PRIOR ART DOCUMENTS

Patent Literature

[Patent Literature 1]: JP-A-2013-229168

SUMMARY OF THE INVENTION

Technical Problem

However, in the waterproof structure disclosed in Patent Literature 1, when the male housing is brought into contact with the sealing plate, an excessive load may be generated on at least one of both housings. For example, when the axial length of one housing is formed at the upper limit of the tolerance or when the male housing is pressed against the seal plate in a state in which foreign matter or the like is caught in the gap between the male housing and the seal plate, the male housing exceeds the elastic limit and plastically deforms, and the waterproof performance may be deteriorated.

The present invention has been made in view of such a problem, and an object thereof is to provide a waterproof structure of a connector which can prevent deterioration of waterproof performance due to plastic deformation of a connector.

Solution to Problem

In order to solve the above problem, a waterproof structure of a connector of the present invention is a waterproof structure of a connector in which cavities respectively accommodating terminals are formed respectively in a pair of housings configured to be fitted to each other. In each of the pair of housings, an annular member surrounding an opening of the cavity is formed to protrude in a fitting direction. One of the annular members has a plurality of corner parts in which an outer circumferential surface is inclined so as to spread outward in a radial direction from a leading end to inward. The outer circumferential surface presses an inner circumferential surface of the other annular member in fitting, and in a cross section orthogonal to the fitting direction. The plurality of corner parts are positioned to be symmetrical with each other with respect to a central axis of the annular member. A curvature of the outer circumferential surface of the plurality of corner parts is larger than a curvature of the outer circumferential surface of other portions. An inclination angle of the outer circumferential surface of the corner part with respect to the fitting direction is larger than an inclination angle of the outer circumferential surface of other portions with respect to the fitting direction.

According to this configuration, the outer circumferential surface of one annular member is formed in a shape that presses the inner circumferential surface of the other annular member. Therefore, when the pair of housings is fitted to each other, the inner circumferential surface of the other annular member is elastically deformed by being pressed by the outer circumferential surface of the one annular member, and the outer circumference of the one tubular member is pushed by the restoring force of this elastic deformation. In this manner, since the annular members are pressed against each other over the entire circumference within the elastic limit, it is possible to prevent water from entering between the annular members. In this way, it is possible to prevent deterioration of the waterproof performance of the connector due to plastic deformation. Further, by bringing the annular members into direct contact with each other, there is no need for a space for providing the rubber packing inside the connector, and the outer diameter size of the connector can be reduced. As a result, miniaturization of the connector can be achieved.

Between the corner having a large curvature and the inner circumferential surface of the other annular member, a gap corresponding to the inclination angle of the corner having a large curvature is formed. That is, at the time of fitting the pair of housings, the timing at which the inner circumferential surface of the other annular member abuts against the corner part having a large curvature of the outer circumferential surface is later than the other portion of the outer circumferential surface. As a result, the amount of wrap between the outer circumferential surface and the inner circumferential surface of the corner part having a large curvature becomes relatively smaller than the other portions, and the strain generated in the corner part having a large curvature of the outer circumferential surface is dispersed. Accordingly, it is possible to alleviate the insertion load when one of the annular members is inserted into the other annular member, which makes it possible to reduce the insertion load at the time of fitting the pair of housings. As a result, assembly workability of the connector can be improved.

In this case, one of the pair of housings is inserted into the other housing formed into a tubular shape, and the outer circumferential surface of one housing has at least three protruding parts for pressing the inner circumferential surface of the other housing, and the protruding parts are preferably spaced apart from each other in the circumferential direction.

According to configuration, since one housing inserted into the other housing is supported on the inner circumferential surface of the other housing via each protruding part, it is possible to prevent rattling of one housing, and it is possible to improve the waterproof property by satisfactorily maintaining the contact state (for example, contact angle) between the annular members. In addition, according to this, since one housing can be supported with a simple structure, the connector structure is simplified and the miniaturization of the waterproof connector is facilitated.

Further, the protruding part may be formed on the inner circumferential surface of the other housing, rather than the outer circumferential surface of the one housing. That is, the inner circumferential surface of the other housing has at least three protruding parts which presses the outer circumferential surface of one housing, and the protruding parts can be configured to be disposed apart from each other in the circumferential direction.

Advantageous Effects of the Invention

According to the present invention, it is possible to provide a waterproof structure for a connector that prevents degradation in waterproof performance due to plastic deformation of the connector. Further, according to the present invention, it is possible to provide a waterproof structure of a connector which enables miniaturization of the connector. Further, according to the present invention, it is possible to provide a waterproof structure of the connector which improves the assembling workability of the connector due to the small insertion load of the housing.

DESCRIPTION OF EMBODIMENTS

Hereinafter, an embodiment of a waterproof structure of a waterproof connector to which the present invention is applied will be described with reference to FIGS. 1 to 11. In the present embodiment, the waterproof connector mounted on an automobile, a motorcycle, or the like is described as an example, but the waterproof structure of the connector of the present invention can be applied to connectors for various purposes.

Figure 1:
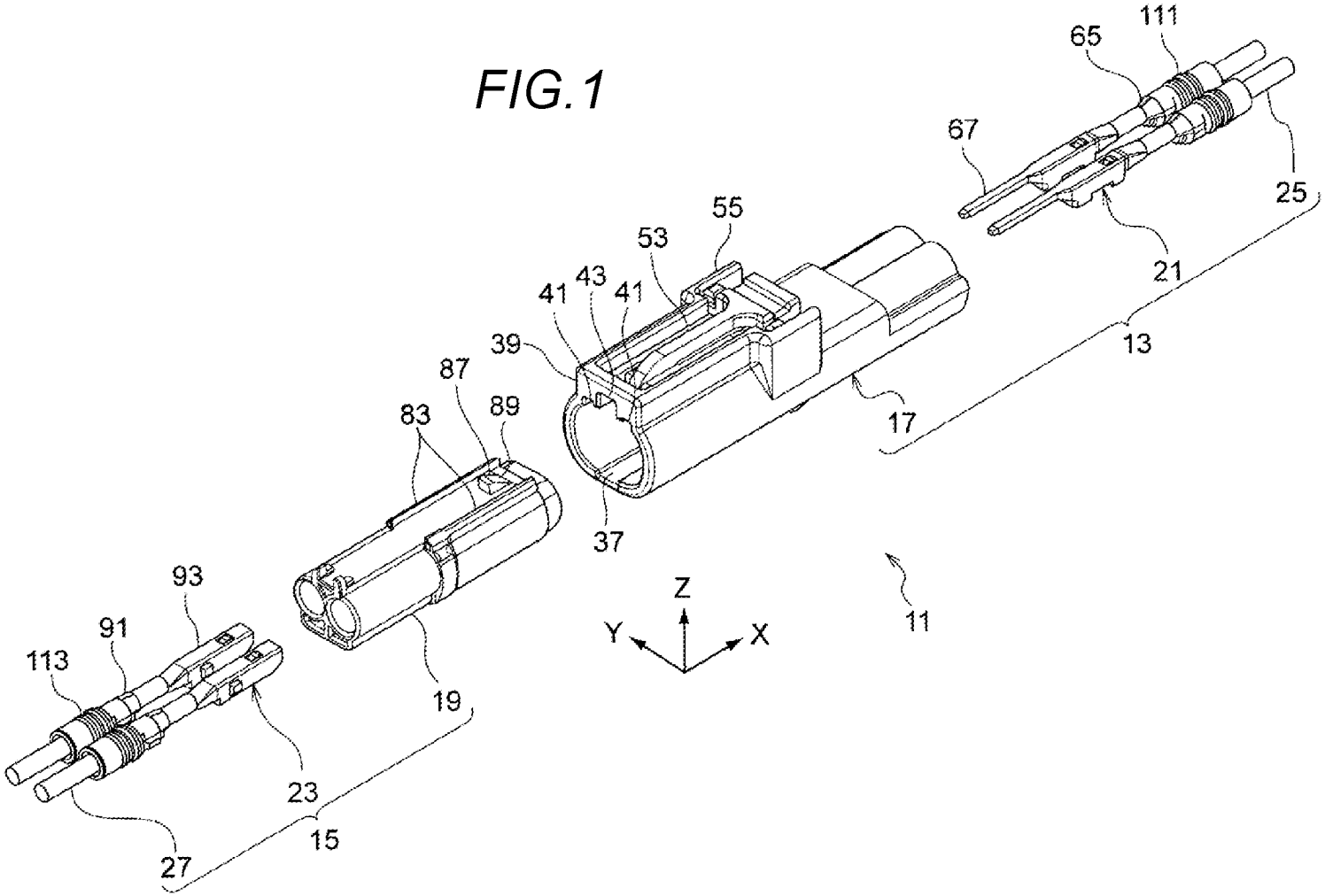
FIG. 1 is an exploded perspective view of an embodiment of a waterproof connector according to the present invention.
Figure 2:
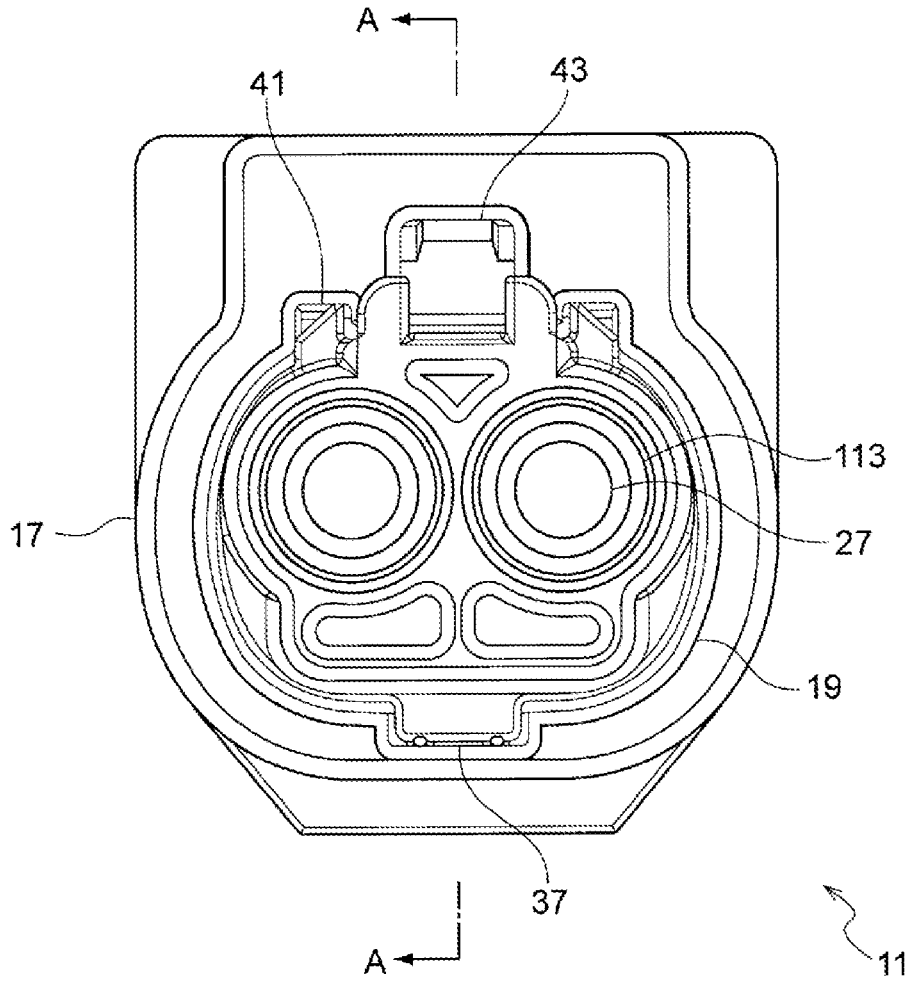
FIG. 2 is a diagram of the waterproof connector of FIG. 1 as seen from a rear side of the female connector.

As illustrated in FIGS. 1 and 2, a waterproof connector (hereinafter referred to as a connector) 11 of the present embodiment has a male connector 13 and a female connector 15. A male housing (the other housing) 17 of the male connector 13 and the female housing (one housing) 19 of the female connector 15 are fitted to each other in the connector 11, thereby electrically connecting and the male terminal 21 accommodated in the male housing 17 and the female terminal 23 accommodated in the female housing 19. An electric wire 25 is connected to the male terminal 21, and an electric wire 27 is connected to the female terminal 23. The female housing 19 is locked in a state of being inserted inside the male housing 17. In the present embodiment, an example in which two terminals are accommodated in each connector will be described, but the number of accommodated terminals is not limited to two. In the following description, a X direction in FIG. 1 is defined as a front-rear direction, a Y direction is defined as a width direction, a Z direction is defined as a height direction, and a fitting direction of the male and female connector is defined as the front, respectively. Further, an upper side of FIG. 1 is defined as an upper part.

Figure 3:
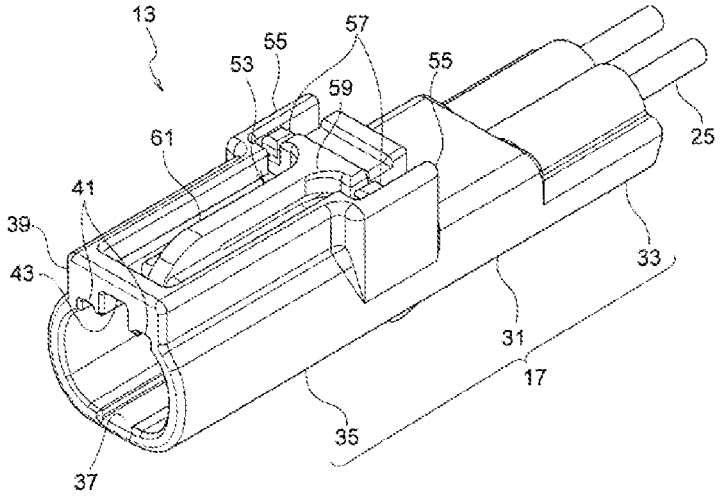
FIG. 3 is an external perspective view of a male connector.
Figure 6:
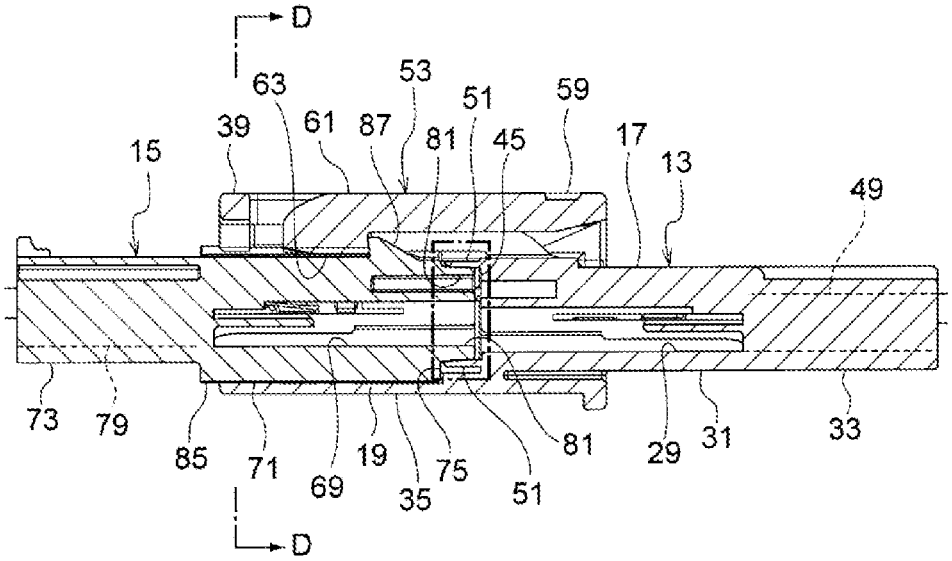
FIG. 6 is a cross-sectional view taken along the line A-A of FIG. 2.

The male connector 13 has a male housing 17 formed in a tubular shape with an insulating synthetic resin, and a male terminal 21 accommodated in the male housing 17 from the rear part. As illustrated in FIGS. 3 and 6, in the male housing 17, a tubular base part 31 formed with two male terminal accommodating chambers (cavities) 29 which accommodates two male terminals 21, respectively, an electric wire holding portion 33 protruding rearward from the base part 31, and a hood portion 35 protruding forward from the base part 31 are integrally formed.

The hood portion 35 is formed in a tubular shape having a circumferential wall continuous with the circumferential wall of the base part 31, and a cross section orthogonal to the front-rear direction is an oval shape in which a width direction is a longitudinal direction. As illustrated in FIG. 3, the hood portion 35 has a guide groove 37 extending in the front-rear direction of the inner wall, and a plate-like wall portion 39 rising upwards to be flush with the front end surface. The wall portion 39 has a pair of first notched portions 41 formed by notching upward from the lower end, and a second notched portion which is located inside the first notched portions 41 and is notched upward from the lower end 43.

Figure 4:
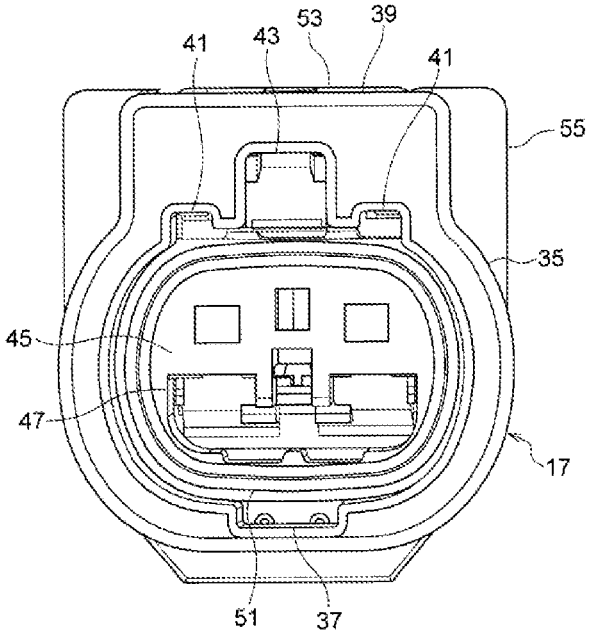
FIG. 4 is a front view of the male connector of FIG. 3.

The respective male terminal accommodating chambers 29 are arranged in parallel in the width direction of the male housing 17 and is formed to be partitioned by partition walls (not illustrated), and each of the male terminal accommodating chambers 29 is engaged with a male terminal 21 (not illustrated) extending inward, thereby holding (locking) the respective male terminals 21 at the setting position. As illustrated in FIGS. 4 and 6, each of the male terminal accommodating chambers 29 is formed by causing an opening 47 that opens to the front end surface 45 of the base part 31 surrounded by the hood portion 35, and a through hole 49 that penetrates the wire holding portion 33 in the front-rear direction to communicate with each other in the front-rear direction. A tubular male side annular member 51 projecting forward from the periphery of the opening 47 of the front end surface 45 so as to surround the opening 47 is provided inside the hood portion 35. The outer circumferential surface of the male side annular member 51 is disposed away from the inner circumferential surface of the hood portion 35, and the front end surface is located behind the front end surface of the hood portion 35.

As illustrated in FIG. 3, the male housing 17 has a lock arm 53 extending forward and supported cantilevered. The lock arm 53 has a base end portion 59 supported by a pair of wall portions 55 erected upward from both side surfaces in the width direction of the base part 31 via the leg portions 57, and an arm portion 61 extending forward from the base end portion 59.

In the lock arm 53, the front end portion of the arm portion 61 is displaced upward in the front-rear direction with the base end portion 59 as a fulcrum. As illustrated in FIG. 6, a lock portion 63 protruding downward is formed in the lower portion of the front end of the arm portion 61, thereby locking and the female housing 19 fitted in the male housing 17 via the lock portion 63. As illustrated in FIG. 3, the wall portions 39 and 55 respectively positioned on the front side and on both sides the width direction of the lock arm 53 are provided to surround the lock arm 53 from the base part 31 to the hood portion 35, and the upper end surfaces of the wall portions 39 an 55 are set at the same height as or at a position higher than the upper end surface of the lock arm 53.

As illustrated in FIG. 1, the male terminal 21 is formed of a conductive metal plate or the like, and the wire connecting portion 65 for crimping and connecting the core wire of the electric wire 25, and a male tub 67 connected to the female terminal 23 are integrally formed. The male tab 67 is formed in a rod shape extending in the front-rear direction, protrudes from the front end surface 45 in a state in which the male terminal 21 is locked to the lance of the male terminal accommodating chamber 29, and is set to the length in which the leading end is positioned forward from the front end of the male side annular member 51.

Figure 5:
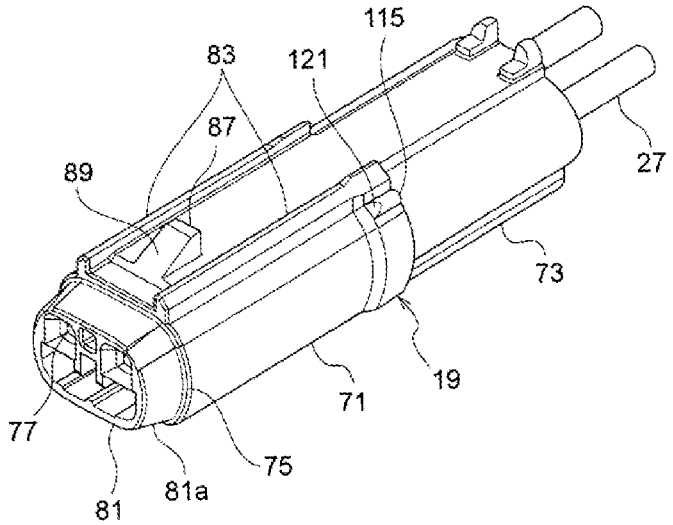
FIG. 5 is an external perspective view of the female connector.

On the other hand, as illustrated in FIG. 1, the female connector 15 has a female housing 19 formed in a tubular shape with an insulating synthetic resin, and a female terminal 23 accommodated in the female housing 19 from the rear. As illustrated in FIGS. 5 and 6, the female housing 19 has a cross section orthogonal to the front-rear direction formed substantially similar to the inner circumferential surface of the hood portion 35 of the male housing 17, and a base part 71 in which two female terminal accommodating chambers 69 (cavities) for housing the two female terminals 23 are formed, and an electric wire holding portion 73 which projects rearward from the base part 71 are integrally formed. Each of the female terminal accommodating chambers 69 is arranged in parallel in the width direction of the female housing 19 and is formed by being partitioned by a partition wall (not illustrated). A lance (not illustrated) extending in the female terminal accommodating chamber 69 is engaged with each female terminal 23, thereby holding (locking) the female terminal 23 at the setting position.

As illustrated in FIGS. 5 and 6, in the female terminal accommodating chamber 69, an opening 77 that opens the front end surface 75 of the base part 71, and a through hole 79 penetrating the electric wire holding portion 73 in the axial direction are formed to communicate with each other in the front-rear direction. The base part 71 is provided with a tubular female side annular member 81 which projects forward from the front end surface 75 so as to surround the opening 77 from the circumferential edge of the opening 77. The female side annular member 81 has an outer circumferential surface 81*a* in which the outer circumferential surface of the base part 71 is reduced in a stepped shape, and the outer circumferential surface 81*a* is formed to be inclined in a truncated cone shape so as to be tapered forward. In other words, the outer circumferential surface 81*a* is inclined so as to spread outward in the radial direction from the leading end toward the back (toward the base part 71).

The female housing 19 has a pair of protruding parts 83 (FIG. 5) extending in the front-rear direction from the upper surface of the base part 71 and a stepped part 85 (FIG. 6) extending axially from the lower surface of the base part 71. The pair of protruding parts 83 are provided substantially parallel to each other in the width direction, and when inserting the female housing 19 into the male housing 17, respectively, the protruding parts 83 pass through the first notched portion 41 of the male housing 17. A locking portion 87 projecting upward is provided inside the pair of protruding parts 83. An inclined surface 89 inclined downward toward the front is formed in the locking portion 87. When the female housing 19 is inserted into the male housing 17, the locking portion 87 passes through the second notched portion 43 of the male housing 17 and pushes up the arm 53 along the inclined surface 89.

As illustrated in FIG. 1, the female terminal 23 is formed of a conductive metal plate material or the like, and a wire connection portion 91 for crimping and connecting the core wire of the electric wire 27, and a square tubular electric contact portion 93 into which the male tab 67 of the male terminal 21 is inserted are integrally formed. In a state where the female terminal 23 is engaged with the lance of the female terminal accommodating chamber 69, the electric contact portion 93 is positioned at a position where it is flush with the opening 77 or retracted from the opening 77 of the base part 71 by the set distance.

Figure 7:
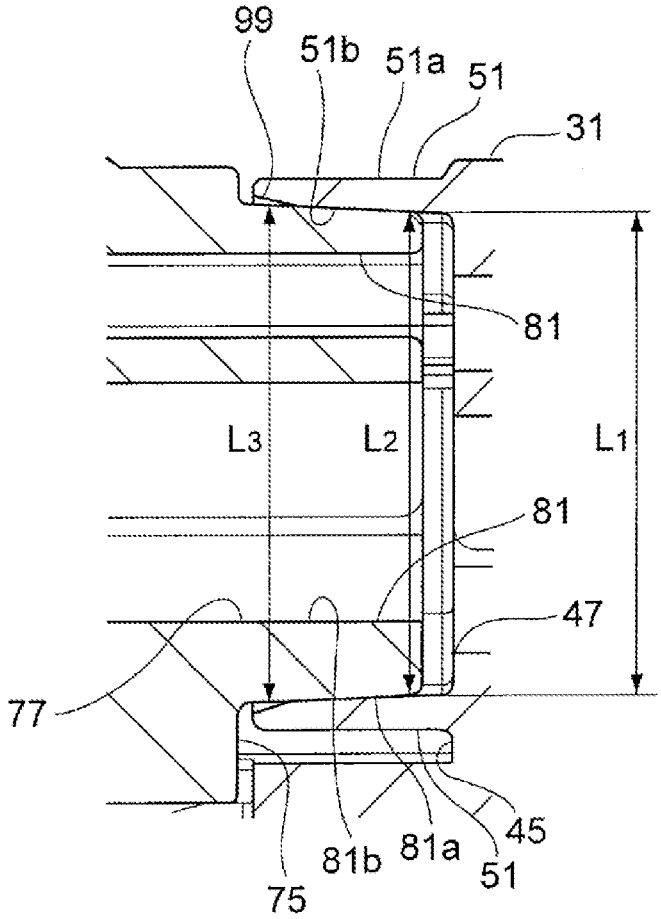
FIG. 7 is a partial enlarged view of a frame section of FIG. 6.

Next, the configurations of the male side annular member 51 and the female side annular member 81 will be described in detail with reference to FIGS. 7 and 8. FIG. 7 is an enlarged view of the inside of the frame section of FIG. 6, and FIGS. 8(*a*) to 8(*c*) are enlarged perspective views of the female side annular member 81. In the present embodiment, as illustrated in FIG. 7, when the male housing 17 and the female housing 19 are fitted together, the female side annular member 81 is fitted inside the male side annular member 51, and the outer circumference of the female side annular member 81 are pressed against the inner circumferential surface of the male side annular member 51 so that the annular members come into watertight contact with each other.

The male side annular member 51 is a resinous tubular member extending in a tubular shape from the periphery of the opening 47 of the base part 31 of the male housing 17, and a cross section in a direction perpendicular to the front-rear direction is formed in a substantially oval shape in which the width direction is a longitudinal direction (FIG. 3). The male side annular member 51 is formed such that the outer circumferential surface 51*a* and the inner circumferential surface 51*b* extend in the front-rear direction, respectively, and the thickness dimensions of the inner and outer circumferential surfaces are set to be smaller than the thickness dimensions of the inner and outer circumferential surfaces of the female side annular member 81. Therefore, the male side annular member 51 has higher elasticity than the female side annular member 81. A front end portion (a leading end portion) of the inner circumferential surface 51*b* of the male side annular member 51 has an inclined surface 99 which widens toward the front end surface, and the female side annular member 81 is guided toward the inner side the male annular member 51 along the inclined surface 99.

The female side annular member 81 is a resinous tubular member extending in a tubular shape from the periphery of the opening 77 of the base part 71 of the female housing 19, and the cross section in the direction orthogonal to the front-rear direction is a substantially oval shape in which the width direction is the longitudinal direction, and is substantially similar to the cross section of the inner circumferential surface 51*b* of the male side annular member 51. An outer circumferential surface 81*a* of the female side annular member 81 is inclined in a direction in which the thickness dimension (thickness) between the inner circumferential surface 81*b* extending in the front-rear direction increases from the front end (leading end) to the back (rear). In other words, the outer circumferential surface 81*a* of the female side annular member 81 is inclined so as to spread outward in the radial direction from the front end (leading end) to the back (rear). The female side annular member 81 having the inclined outer circumferential surface 81*a* in this manner has a shape in which the outer circumferential surface 81*a* on the back side is pressed against the inner circumferential surface 51*b* of the male side annular member 51. That is, the female side annular member 81 is formed into a truncated cone shape inclined inwardly in a tapered manner with respect to the front-rear direction over the entire circumference of the outer circumferential surface 81*a*.

Here, the cross-sectional shape of the annular members 51 and 81 orthogonal to the front-rear direction of both the annular members will be described by taking the outer circumferential surface 81*a* of the female side annular member 81 as an example. As illustrated in FIGS. 8(*a*) to 8(*c*), the cross-sectional shape of a portion of the outer circumferential surface 81*a* of the female side annular member on the rear side (rear part), that is, the portion pressing the inner circumferential surface 51*b* of the male side annular member 51 is formed to have an upper surface 101 and a lower surface 103 extending in the width direction, both side surfaces 105 and 107 located on both sides in the width direction and formed in a gentle circular arc shape symmetrical to each other, and four corner parts 109*a* to 109*d* which is symmetrically positioned with respect to the central axis of the female side annular member 81 and has the largest curvature (the smallest radius of curvature).

On the other hand, the cross-sectional shape of the inner circumferential surface 51*b* of the male side annular member 51 is substantially similar to the cross-sectional shape of the outer circumferential surface 81*a* of the female side annular member 81. Since the male side annular member 51 has elasticity and is elastically deformed along the outer circumferential surface 81*a* of the female side annular member 81, even if the male side annular member 51 can press the inner side of the outer circumferential surface 81*a* over the entire circumferential direction, it is not limited to a similar figure.

In the present embodiment, as illustrated in FIG. 7, an inner dimension between the inner circumferential surfaces 51*b* facing each other in the height direction of the male side annular member 51 is defined as L1, an outer dimension in the height direction at the front end portion of the female side annular member 81 is set as L2, and an outer dimension between outer circumferential surfaces 81*a* in the height direction on the rear side is defined as L3. At this time, both the annular members are set to have a relation of L3>L1>L2, and this relationship is set over the entire circumferential direction. Accordingly, when the female side annular member 81 is inserted into the male side annular member 51, the male side annular member 51 is elastically deformed to the outside by the inner circumferential surface 51*b* being pressed against the outer circumferential surface 81*a* of the female side annular member 81, and the outer circumferential surface 81*a* of the female side annular member 81 is pressed inward by the restoring force of the elastic deformation. As described above, since both the annular members are pressed against each other in the entire circumferential direction within the elastic limit, water is prevented from entering between the annular members, and the waterproof performance of the connector 11 due to plastic deformation is prevented from deteriorating.

In the present embodiment, when the female side annular member 81 is inserted into the male side annular member 51, the female side annular member 81 moves, while the outer circumferential surface 81*a* thereof is pressed against the inner circumferential surface 51*b* of the male side annular member 51. At this time, the curvature of the corner parts 109*a* to 109*d* of the outer circumferential surface 81*a* is set to be larger than the other portions, and the strength is relatively high. Therefore, when the outer circumferential surface 81*a* is pressed against the inner circumferential surface 51*b*, the stress is concentrated on the corner parts 109*a* to 109*d* which are less likely to be elastically deformed than the other portions, and the insertion load of the female side annular member 81 increases.

Figure 8:
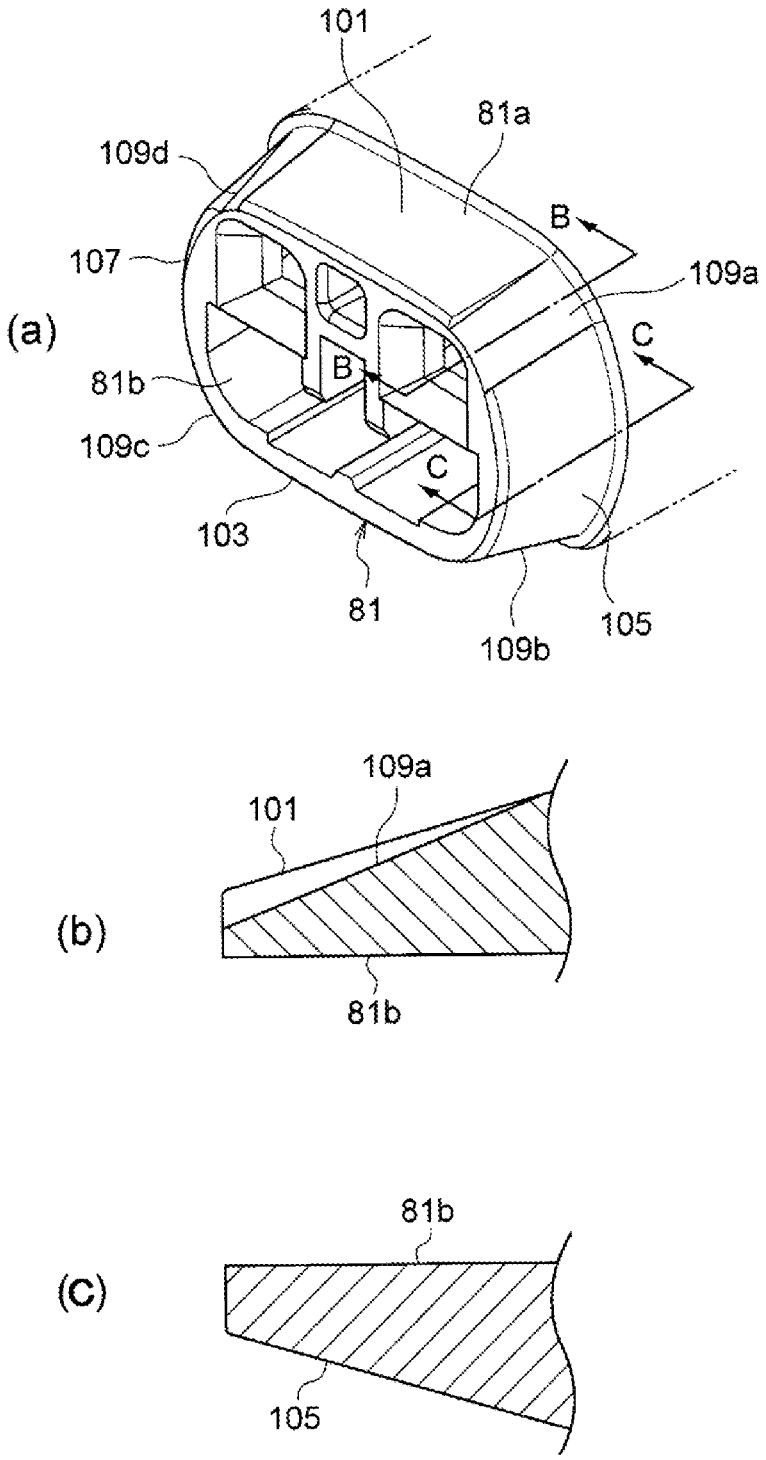
FIG. 8(*a*) is a partially enlarged view of a female side annular member, FIG. 8(*b*) is a cross-sectional view taken along the arrow B-B in FIG. 8(*a*), and FIG. 8(*c*) is a cross-sectional view taken along the arrow C-C in FIG. 8(*a*).

As illustrated in FIGS. 8(*a*) to 8(*c*), in order to avoid an increase in the insertion load of the female side annular member 81, in the female side annular member 81 of this embodiment, the inclination angle (FIG. 8(*b*)) of the corner parts 109*a* to 109*d* having the largest curvature on the outer circumferential surface 81*a* with respect to the front-rear direction is set to be larger than the inclination angle of another portion (FIG. 8(*c*)) in the circumferential direction. That is, an outer circumferential surface 81*a* against which the inner circumferential surface 51*b* of the male side annular member 51 abuts is formed on the back side (rear part), the corner parts 109*a* to 109*d* are inclined greatly toward the inside of the female side annular member 81, and an amount of step difference between the outer circumferential surface 81*a* on both sides in the circumferential direction as approaching the front end. Thus, when the outer circumferential surface 81*a* and the inner circumferential surface 51*b* come into contact with each other, a gap according to the inclination angle of the corner parts 109*a* to 109*d* is formed between the corner parts 109*a* to 109*d* and the inner circumferential surface 51*b*. Thus, when the male housing 17 and the female housing 19 are fitted to each other, the timing at which the inner circumferential surface 51*b* of the male side annular member 51 abuts against the corner parts 109*a* to 109*d* becomes later than other portions in the circumferential direction of the outer circumferential surface 81*a*. That is, the amount of lap between the outer circumferential surface 81*a* and the inner circumferential surface 51*b* of each of the corner parts 109*a* to 109*d* is smaller than other portions in the circumferential direction, and the stress (strain) generated in the corner parts 109*a* to 109*d* is dispersed. Therefore, according to the present embodiment, it is possible to reduce the insertion load when the female side annular member 81 is inserted into the male side annular member 51, and the assembling workability of the connector 11 can be improved.

Next, an example of assembling method and fitting operation of both housings will be described. First, as illustrated in FIG. 1, the male terminal 21 to which the electric wire 25 with the rubber stopper 111 attached thereto is connected is inserted into the male housing 17 (the male terminal accommodating chamber 29) together with the rubber plug 111. The male terminal 21 inserted into the male housing 17 is engaged with a lance (not illustrated) and locked at a predetermined position in the male terminal accommodating chamber 29. The gap between the outer circumferential surface of the electric wire passing through the male terminal accommodating chamber 29 and the inner surface of the male terminal accommodating chamber 29 is sealed by the rubber plug 111. Similarly, the female terminal 23 to which the electric wire 27 with the rubber stopper 113 attached thereto is connected is inserted into the female housing 19 (female terminal receiving chamber 69) together with the rubber plug 111. The male terminal 23 inserted into the female housing 19 is engaged with a lance (not illustrated) and locked in a predetermined position of the female terminal accommodating chamber 69. The gap between the outer circumferential surface of the electric wire passing through the female terminal receiving chamber 69 and the inner surface of the female terminal receiving chamber 69 is sealed by the rubber plug 113.

Figure 9:
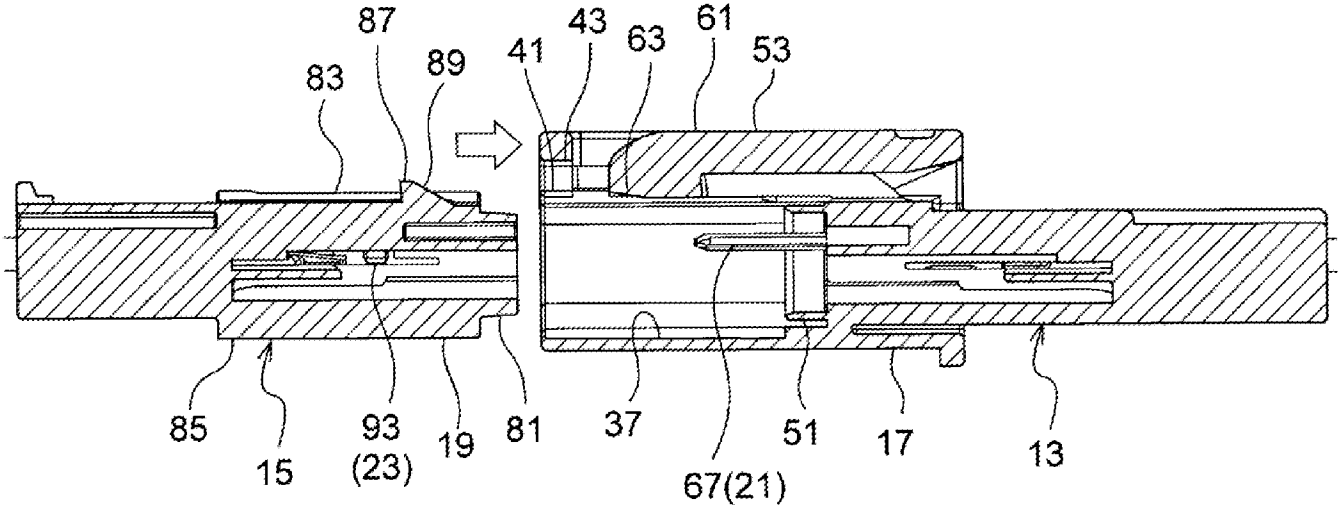
FIG. 9 is a diagram for explaining a fitting operation between the male connector and the female connector.

In this state, as illustrated by an arrow in FIG. 9, the female housing 19 of the female connector 15 is inserted into the male housing 17 of the male connector 13. When the female housing 19 is inserted into the male housing 17, the pair of protruding parts 83 of the female housing 19 pass through the first notched portion 41 of the male housing 17, respectively, and the locking portion 87 of the female housing 19 passes through the second notched portion 43 of Fig. Also, the stepped part 85 of the female housing 19 is guided along the guide groove 37 of the male housing 17.

When the female housing 19 is inserted into the back of the male housing 17, the lock arm 53 is moved along the inclined surface 89 of the locking portion 87 of the female housing 19 so that the lock portion 63 climbs over the locking portion 87, and the arm portion is bent and deformed upward. When the lock portion 63 climbs over the locking portion 87, the arm portion 61 elastically returns. As a result, the locking portion 87 is locked to the lock portion 63, and both the housings are locked in a proper fitted state.

On the other hand, when the female housing 19 is inserted to a predetermined position of the male housing 17, insertion of the female side annular member 81 into the male side annular member 51 is started. The female side annular member 81 inserted inward along the inclined surface 99 of the male side annular member 51 moves, while the outer circumferential surface 81*a* presses the inner circumferential surface 51*b* of the male side annular member 51 and rests in a manner of pushing the inner circumferential surface 51*b* over the entire circumference. That is, the inner circumferential surface 51*b* and the outer circumferential surface 81*a* of the male side annular member 51 and the female side annular member 81 are pressed against each other over the entire circumferential direction, so that the male side annular member 51 and the female side annular member 81 are in watertight contact with each other, and water is prevented from entering the opening 47 of the male connector 13 and the opening 77 of the female connector 15, respectively. When the housings 17 and 19 are fitted to each other, the leading end surface of the male side annular member 51 is disposed away from the front end surface 75 of the female housing 19, and the leading end surface of the female side annular member 81 is disposed to be spaced apart from the front end surface 45 of the male housing 17.

In the present embodiment, when the male connector 13 and the female connector 15 are fitted together, the male side annular member 51 is pressed from the inside by the female side annular member 81 and is pushed out within the elastic limit, so that the gap between the male side annular member 51 and the female side annular member 81 is sealed. Therefore, entry of water into the openings 47 and 77 can be prevented. As a result, it is possible to improve the waterproof property of the connector 11. Further, by bringing the male side annular member 51 and the female side annular member 81 into direct contact with each other to form a waterproof structure, a rubber packing or the like for waterproofing becomes unnecessary, and the outer diameter size of the connector 11 can be reduced. As a result, miniaturization and cost reduction of the connector 11 can be achieved.

Further, in the present embodiment, since the male side annular member 51 and the female side annular member 81 are in contact with each other within the elastic limit, for example, when the connector 11 vibrates, since the male side annular member 51 and the female side annular member 81 integrally expands and contracts, it is possible to absorb vibrations with each other. Therefore, it is possible to prevent degradation over time of the connector 11 and deterioration of waterproof property due to repetition of vibration.

Further, in the present embodiment, the inclination angle of the corner parts 109*a* to 109*d* on the outer circumferential surface 81*a* of the female side annular member 81 is set to be larger than the inclination angle of the other portion in the circumferential direction. As a result, the amount of lap between the corner parts 109*a* to 109*d* and the inner circumferential surface 51*b* becomes relatively small, and the strain of the corner parts 109*a* to 109*d* is dispersed. Therefore, the insertion load when inserting the female side annular member 81 into the male side annular member 51 is reduced, and it is possible to reduce the insertion load at the time of fitting the pair of housings. As a result, the assembling workability of the connector 11 can be improved.

Further, in this embodiment, when the female housing is inserted into the male housing 17, the pair of protruding parts 83 are guided to the first notched portion 41 of the male housing 17, respectively, and the stepped part 85 is guided along the guide groove 37. Thus, the insertion direction of the female housing 19 with respect to the male housing 17 is restricted, and while bringing the female side annular member 81 into contact with the set position of the male side annular member 51 at an appropriate angle, the waterproof property of the two annular members 51, 81 can be stably maintained.

The pair of protruding parts 83 and the stepped part 85 have a function of guiding the female housing 19 to a predetermined position of the male housing 17 and positioning the female housing 19 accommodated in the male housing 17, respectively. Neither presses the inner circumferential surface of the male housing 17 nor can completely prevent rattling of the female housing 19 accommodated in the male housing 17.

Figure 10:
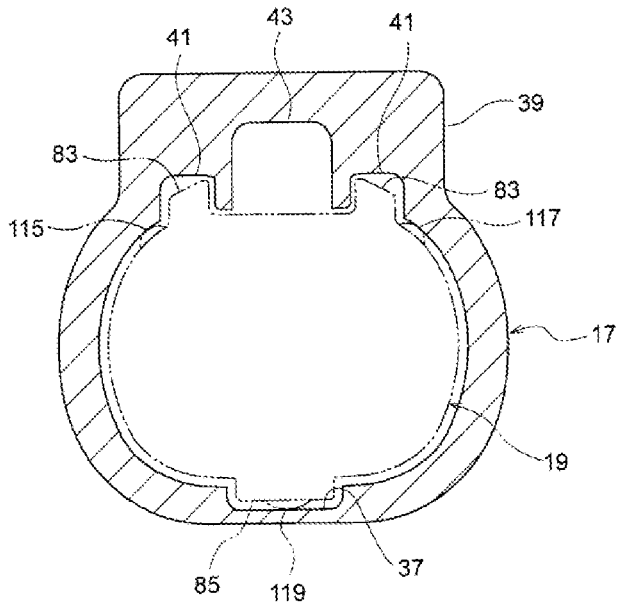
FIG. 10 is a cross-sectional view taken along arrow D-D of FIG. 6.

In this respect, in this embodiment, as illustrated in FIG. 10, three protruding portions 115, 117, and 119 for pressing the inner circumferential surface of the male housing 17 are provided on the outer circumferential surface of the base part 71 of the female housing 19. The protruding parts 115, 117, and 119 are arranged so as to be spaced apart from each other in the circumferential direction, the protruding part 115 and the protruding part 117 are disposed in the vicinity of the pair of protruding parts 83, respectively, and the protruding part 119 is disposed in the central part of the stepped part 85 in the width direction. Each of the protruding parts 115, 117 and 119 extends in the front-rear direction, and a cross section orthogonal to the front-rear direction is formed in a circular arc shape. The front end surface 121 (FIG. 5) inclines toward the outer circumferential face of the base part 71. That is, each protruding part is pushed into the male housing 17 along the inclined end surface 121.

According to this, the female housing 19 inserted into the male housing 17 is supported at three positions in the circumferential direction on the inner circumferential surface of the male housing 17 via the respective protruding portions 115, 117, and 119. For this reason, the rattling of the female housing 19 is suppressed, and the contact state between the annular members 51 and 81 is maintained satisfactorily. Further, since the female housing 19 is supported by an extremely simple structure, miniaturization of the connector 11 is facilitated. At least three protruding parts may be provided, and more protruding parts may be formed if necessary. However, when the number of protruding parts increases, the frictional resistance at the time of insertion of the female housing 19 into the male housing 17 increases, and the insertion load increases. Therefore, it is preferable that the number of protruding parts is three. Similarly, the cross section orthogonal to the front-rear direction of each protruding part is not particularly limited, but in order to reduce the frictional resistance with the male housing 17, it is preferable to have a circular arc shape.

Figure 11:
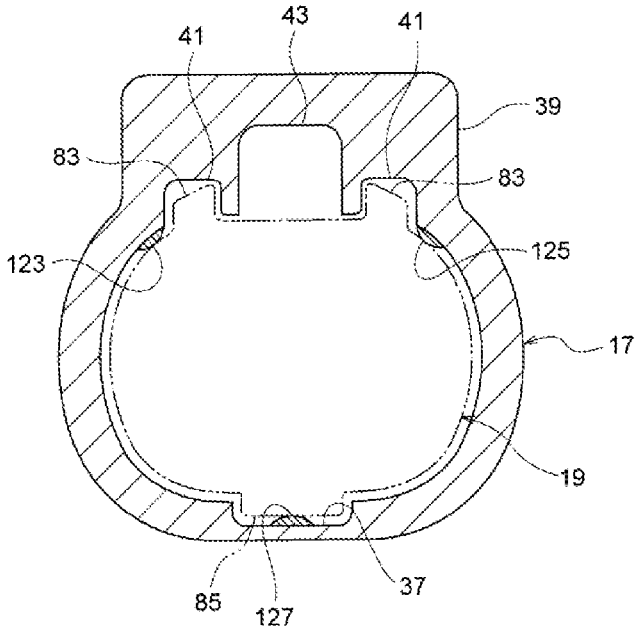
FIG. 11 is a cross-sectional view of another embodiment corresponding to FIG. 10.

Further, as illustrated in FIG. 11, instead of the aforementioned protruding parts 115, 117, and 119, protruding parts 123, 125, and 127 which press the outer circumferential surface of the female housing 19 inserted into the male housing 17 may be formed on the inner circumferential surface of the female housings 19, respectively. Even in this case, each of the protruding parts 123, 125, and 127 is arranged to be spaced apart in the circumferential direction, and at least three protruding parts 123, 125 and 127 may be provided, each protruding part extends in the front-rear direction, and a cross section orthogonal to the front-read direction is formed in a circular arc shape. Even with such a configuration, miniaturization of the connector 11 is facilitated.

Although the embodiment to which the present invention is applied has been described above, this is merely a representative example, and the present invention can be implemented in various forms without departing from the gist thereof.

Here, features of the waterproof structure of the connector and the embodiment of the waterproof connector according to the present invention described above are summarized briefly in the following (1) to (3).

(1) A waterproof structure of a connector (11) in which cavities (29, 69) respectively accommodating terminals (21, 23) are formed respectively in a pair of housings (17, 19) configured to be fitted to each other, wherein in each of the pair of housings, an annular member (51, 81) surrounding an opening of the cavity is formed to protrude in a fitting direction, wherein one of the annular members (81) has a plurality of corner parts (109*a* to 109*d*) in which an outer circumferential surface (81*a*) is inclined so as to spread outward in a radial direction from a leading end to inward, wherein the outer circumferential surface presses an inner circumferential surface of the other annular member (51) in fitting, and in a cross section orthogonal to the fitting direction, wherein the plurality of corner parts are positioned to be symmetrical with each other with respect to a central axis of the annular member, wherein a curvature of the outer circumferential surface of the plurality of corner parts is larger than a curvature of the outer circumferential surface of other portions, and wherein an inclination angle of the outer circumferential surface of the corner part with respect to the fitting direction is larger than an inclination angle of the outer circumferential surface of other portions with respect to the fitting direction.

(2) The waterproof structure of the connector according to the above (1), wherein one housing (19) of the pair of housings is configured to be inserted into the other housing (17) formed in a tubular shape, wherein the outer circumferential surface of one housing has at least three protruding parts (115, 117, 119) pressing the inner circumferential surface of the other housing, and wherein the protruding parts are disposed to be spaced from each other in a circumferential direction.

(3) The waterproof structure of the connector according to the above (1), wherein one housing (19) of the pair of housings is configured to be inserted into the other housing (17) formed in a tubular shape, wherein the inner circumferential surface of the other housing has at least three protruding parts (123, 125, 127) pressing the outer circumferential surface of the one housing, and wherein the protruding parts are disposed to be spaced from each other in a circumferential direction.

While the invention has been described in detail and with reference to specific embodiments, it will be apparent to those skilled in the art that various changes and modifications can be made without departing from the spirit and scope of the invention.

This application is based on Japanese Patent Application (Japanese Patent Application No. 2016-1896) filed on Jan. 7, 2016.

INDUSTRIAL APPLICABILITY

According to the waterproof structure of the connector of the present invention, it is possible to prevent deterioration of waterproof performance due to plastic deformation of the connector, to miniaturize the connector, and to reduce the insertion load of the housing, thereby improving assembling workability of the connector. The present invention which exerts this effect is useful in the technical field of connectors.

REFERENCE SIGNS LIST

11: Waterproof connector (connector)
13: Male connector
15: Female connector
17: Male housing (other housing)
19: Female housing (one housing)
21: Male terminal
23: Female terminal
29: Male terminal accommodating room (cavity)
47, 77: Opening
51: Male side annular member

69: Female terminal accommodating chamber (cavity)
81: Female side annular member
109*a* to 109*d*: Corner part
115, 117, 119, 123, 125, 127: Protruding part

The invention claimed is:

1. A waterproof structure of a connector in which cavities respectively accommodating terminals are formed respectively in a pair of housings configured to be fitted to each other, wherein in each of the pair of housings, an annular member surrounding an opening of the cavity is formed to protrude in a fitting direction, wherein one of the annular members has a plurality of corner parts in which an outer circumferential surface is inclined so as to spread outward in a radial direction from a leading end to inward, wherein the outer circumferential surface presses an inner circumferential surface of the other annular member in fitting, and in a cross section orthogonal to the fitting direction, wherein the plurality of corner parts are positioned to be symmetrical with each other with respect to a central axis of the annular member, wherein a curvature of the outer circumferential surface of the plurality of corner parts is larger than a curvature of the outer circumferential surface of other portions of the one of the annular members, and wherein an inclination angle of the outer circumferential surface of the plurality of corner parts with respect to the fitting direction is larger than an inclination angle of the outer circumferential surface of other portions of the one of the annular members with respect to the fitting direction.

2. The waterproof structure of the connector according to claim 1, wherein one housing of the pair of housings is configured to be inserted into the other housing formed in a tubular shape, wherein the outer circumferential surface of one housing has at least three protruding parts pressing the inner circumferential surface of the other housing, and wherein the protruding parts are disposed to be spaced from each other in a circumferential direction.

3. The waterproof structure of the connector according to claim 1, wherein one housing of the pair of housings is configured to be inserted into the other housing formed in a tubular shape, wherein the inner circumferential surface of the other housing has at least three protruding parts pressing the outer circumferential surface of the one housing, and wherein the protruding parts are disposed to be spaced from each other in a circumferential direction.

4. A waterproof structure of a connector in which cavities respectively accommodating terminals are formed respectively in a pair of housings configured to be fitted to each other, wherein in each of the pair of housings, an annular member surrounding an opening of the cavity is formed to protrude in a fitting direction, wherein one of the annular members has a plurality of corner parts in which an outer circumferential surface is inclined so as to spread outward in a radial direction from a leading end to inward, wherein the outer circumferential surface presses an inner circumferential surface of the other annular member in fitting, and in a cross section orthogonal to the fitting direction, wherein the plurality of corner parts are positioned to be symmetrical with each other with respect to a central axis of the annular member, wherein a curvature of the outer circumferential surface of the plurality of corner parts is larger than a curvature of the outer circumferential surface of other portions of the one of the annular members, and wherein a timing at which the inner circumferential surface of the other annular member abuts against the outer circumferential surface of the plurality of corner parts is later than a timing at which the inner circumferential surface of the other annular member abuts against the other portions of the one of the annular members.

5. A waterproof structure of a connector comprising:

a first housing including a first annular member surrounding a first opening of a first cavity, the first annular member having a plurality of corner parts at which an outer circumferential surface is inclined so as to spread outward in a radial direction inward from a leading end, the outer circumferential surface having a curvature that is larger than a curvature of the outer circumferential surface at other portions of the first annular member; and a second housing including a second annular member surrounding a second opening of a second cavity, the second annular member having an inner circumferential surface, wherein the outer circumferential surface presses the inner circumferential surface of the second annular member upon fitting the first housing to the second housing, and in a cross section orthogonal to a fitting direction such that a timing at which the inner circumferential surface of the second annular member abuts against the outer circumferential surface of the plurality of corner parts is later than a timing at which the inner circumferential surface of the second annular member abuts against the other portions of the first annular member.

* * * * *